US006880506B2

(12) United States Patent
Gschwindt et al.

(10) Patent No.: US 6,880,506 B2
(45) Date of Patent: Apr. 19, 2005

(54) INTERNAL COMBUSTION ENGINE WITH AT LEAST TWO CYLINDER BANK ROWS

(75) Inventors: Werner Gschwindt, Sternenfels (DE); Thomas Wasserbaech, Keltern (DE)

(73) Assignee: Dr. Ing. h.c.F. Porsche AG, Stuttgart (DE)

( * ) Notice: Subject to any disclaimer, the term of this patent is extended or adjusted under 35 U.S.C. 154(b) by 0 days.

(21) Appl. No.: 10/289,427

(22) Filed: Nov. 7, 2002

(65) Prior Publication Data

US 2003/0089323 A1 May 15, 2003

(30) Foreign Application Priority Data

Nov. 7, 2001 (DE) ..... 101 54 669

(51) Int. Cl.[7] ..... F01M 9/10

(52) U.S. Cl. ..... 123/90.38; 123/90.33; 123/195 C; 123/198 F

(58) Field of Search ..... 123/90.33, 90.37, 123/90.38, 195 C, 198 E, 198 F, 196 R, 196 CP, 196 M, 572, 573, 574

(56) References Cited

U.S. PATENT DOCUMENTS 3,469,565 A 9/1969 Weber et al. ..... 123/119
3,908,617 A 9/1975 Patridge
4,721,090 A * 1/1988 Kato ..... 123/572
4,958,613 A 9/1990 Hiraoka et al. ..... 123/572
5,069,192 A * 12/1991 Matsumoto et al. ..... 123/572
5,285,754 A 2/1994 Bell ..... 123/90.38
5,752,866 A * 5/1998 Takahashi et al. ..... 440/88 L
6,308,695 B1 * 10/2001 Watanabe et al. ..... 123/572

FOREIGN PATENT DOCUMENTS

DE 19700733 A1 7/1998

* cited by examiner

*Primary Examiner*—Thomas Denion
*Assistant Examiner*—Ching Chang
(74) *Attorney, Agent, or Firm*—Crowell & Moring LLP

(57) ABSTRACT

An internal combustion engine is provided with at least two cylinder banks whose cylinder heads are sealed by cylinder head covers. To ventilate the crankcase from the blow-by gases, ventilation lines are connected to the cylinder head covers and communicate with a negative pressure source, e.g., an intake pipe. The inside of the cylinder head cover is provided with structure for pre-separating the oil from the blow-by gases. An oil separation chamber is equipped with an inlet and an outlet opening, each as a part of the crankcase ventilation in the cylinder head covers. The oil separation chambers communicate with the respective camshaft space through their inlet openings. This arrangement ensures reliable crankcase ventilation in which a portion of the oil carried along by the blow-by gases can already be separated in the cylinder head cover and returned to the camshaft spaces.

9 Claims, 6 Drawing Sheets

INTERNAL COMBUSTION ENGINE WITH AT LEAST TWO CYLINDER BANK ROWS

BACKGROUND OF THE INVENTION

This application claims the priority of German Patent Application No. 101 54 669.6, filed Nov. 7, 2001, the disclosure of which is expressly incorporated by reference herein.

The present invention relates to an internal combustion engine having at least two cylinder banks and more particularly, to an internal combustion engine whose cylinder heads are sealed by cylinder head covers, wherein to ventilate the crankcase from the so-called blow-by gases, ventilation lines are connected to the cylinder head covers and communicate with a negative pressure source, e.g., an intake pipe, and on the inside of the cylinder head cover means are provided for pre-separating the oil from the blow-by gases.

U.S. Pat. No. 3,908,617 discloses a device for crankcase ventilation of an internal combustion engine with two cylinder banks in which ventilation lines mounted above the cylinder head housing or the cylinder head cover remove the blow-by gases located in the crankcase volume and return them to the intake system of the internal combustion engine in a closed circuit. In addition, sheet metal guide elements are mounted on the inside of the cylinder head cover. The blow-by gases flow past these guide elements and a portion of the oil carried along by the blow-by gases is deposited thereon.

SUMMARY OF THE INVENTION

An object of the present invention is to further improve the crankcase ventilation of a multi-bank internal combustion engine such that the oil carried along by the blow-by gases is effectively withdrawn during crankcase ventilation, while the costs for external ventilation lines are reduced. In addition, crankcase ventilation is also to be ensured when the motor vehicle travels uphill or downhill.

According to the invention, this object has been attained by providing, as a part of the crankcase ventilation, an oil separation chamber equipped with an inlet and an outlet opening each is provided in the cylinder head covers, wherein the oil separation chambers communicate with the respective camshaft space via their inlet openings. The oil separation chambers arranged in the cylinder head cover, through which the blow-by gases are guided, can already separate a portion of the entrained oil. The separately configured oil separation chamber makes it possible to "calm" the entering blow-by gases, so that the oil components in the blow-by gases are separated and if necessary returned to the camshaft space through openings that are provided in a wall of the oil separation chamber.

The oil separation chamber is integrated into the cylinder head cover so that the inlet opening for the blow-by gases is arranged substantially in the center of the cylinder head cover in relation to its longitudinal extension. This ensures that even when the motor vehicle travels uphill or downhill, crankcase ventilation via the oil separation chamber is not impaired, despite the lubricating oil present in the camshaft space.

The oil separation chamber is advantageously configured in two parts and consists of a shell-type floor portion that is sealed by a cover element. An additional oil separator is provided in a cylinder head cover. As seen in flow direction of the blow-by gases this oil separator adjoins the second oil separation chamber integrated in the cylinder head cover.

A pressure regulator whose outlet leads to the intake pipe of the internal combustion engine via a connecting line is mounted on the oil separator. Thus, the negative pressure present in the intake pipe as a function of the loading condition of the internal combustion engine can be adjusted to a constant negative pressure value that is suitable for crankcase ventilation.

BRIEF DESCRIPTION OF THE DRAWINGS

These and other objects, features and advantages of the present invention will become more readily apparent from the following detailed description of currently preferred configurations thereof when taken in conjunction with the accompanying drawings wherein.

DETAILED DESCRIPTION OF THE DRAWINGS

Figure 1:
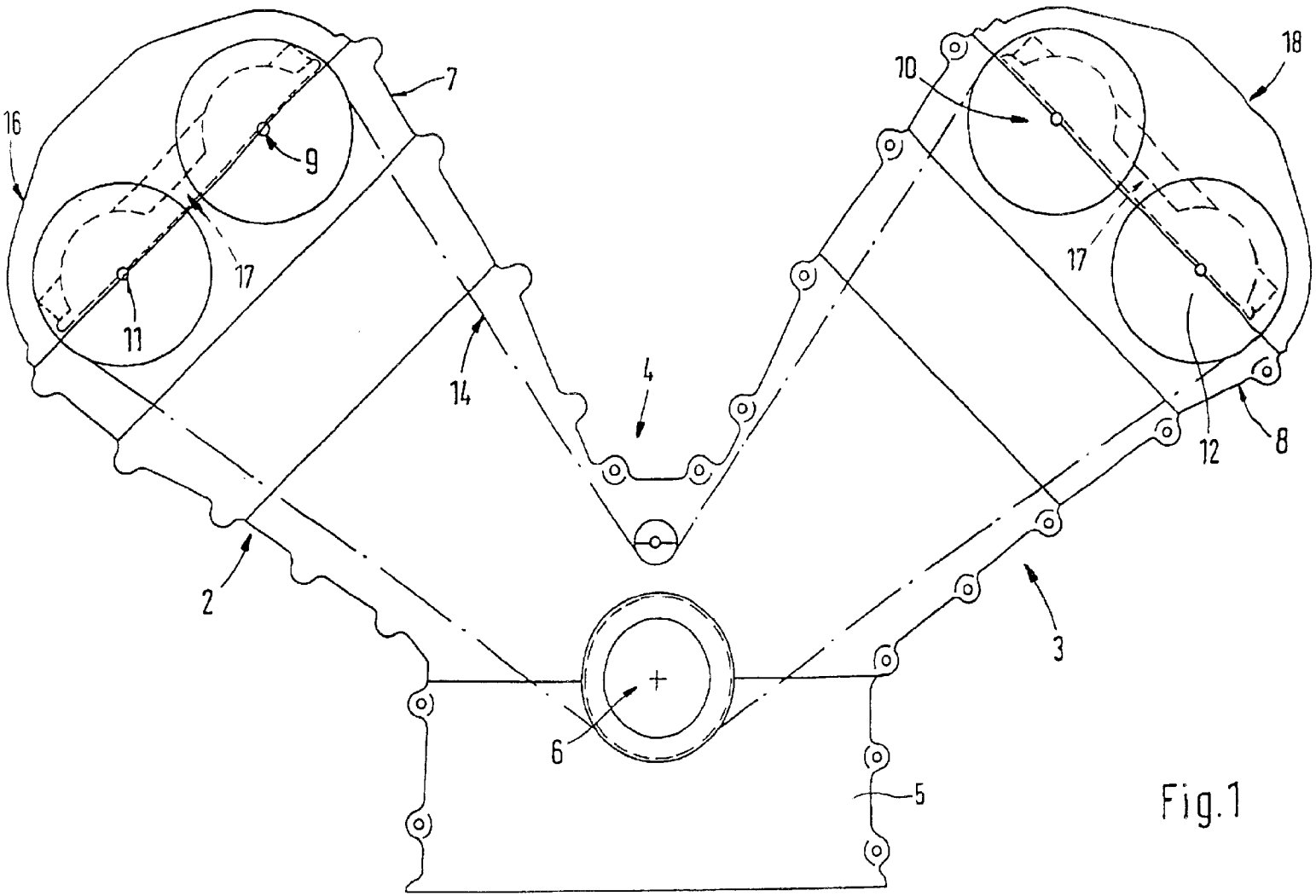
FIG. 1 is a front view of an internal combustion engine.

The internal combustion engine, configured as a V8 engine in a currently contemplated exemplary embodiment, has two cylinder banks 2, 3, which are both integrated in an upper crankcase part 4 that is adjoined by a lower crankcase part 5, which is configured as a crankshaft bearing bracket. Accordingly, a crankshaft 6 is supported between the upper crankcase part 4 and the lower crankcase part 5. The two cylinder banks 2, 3 have two respective cylinder heads 7, 8, which receive, among other things, intake camshafts 9, 10, that are required to control the intake or discharge valves as well as exhaust camshafts 11, 12. The intake camshafts 9, 10 and the exhaust camshafts 11, 12 are driven by a twin drive gear that is arranged on crankshaft 6 and a timing chain 14 that is configured as an endless drive, a so-called duplex chain. The two cylinder heads 7, 8 are sealed towards the top by a cylinder head cover 16, 18 each.

Figure 4:
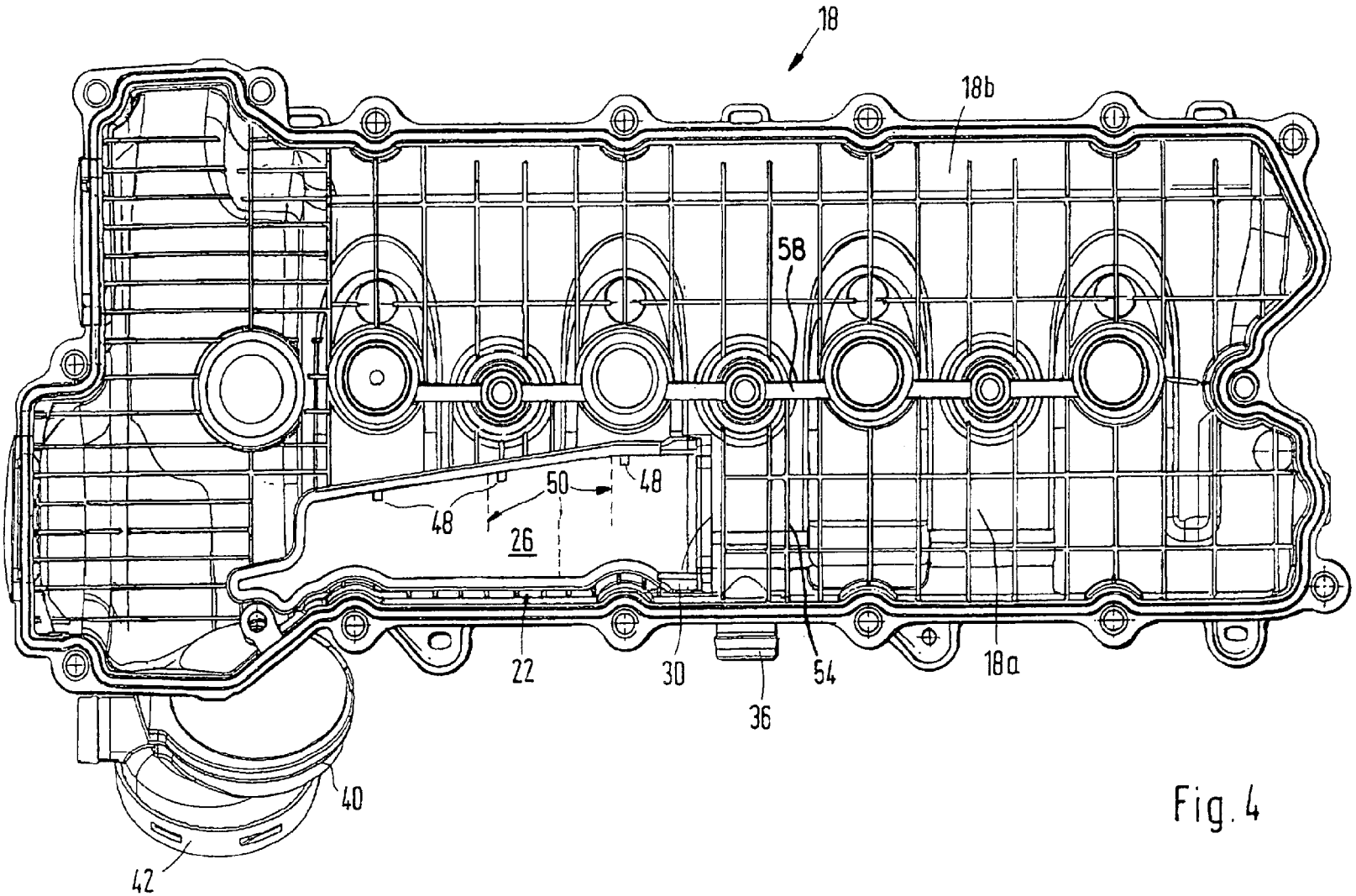
FIG. 4 is an interior view of a second cylinder head cover.

Devices for crankcase ventilation are provided in or on the cylinder head covers 16, 18 of the two cylinder banks 1 to 4 or 5 to 8. These will now be described in greater detail. In principle, the blow-by gases that pass into the crankcase space of the internal combustion engine during combustion or during the compression stroke are guided through ventilation paths (not depicted) that are integrated in the engine compartment into camshaft space 17 from where they are returned to the intake tract of the internal combustion engine. To this end, respective oil separation chambers 20, 22 are integrated into each cylinder head cover 16, 18 and are sealed relative to the camshaft space 17 by the covers 24, 26 shown in FIGS. 4–6.

Figure 2:
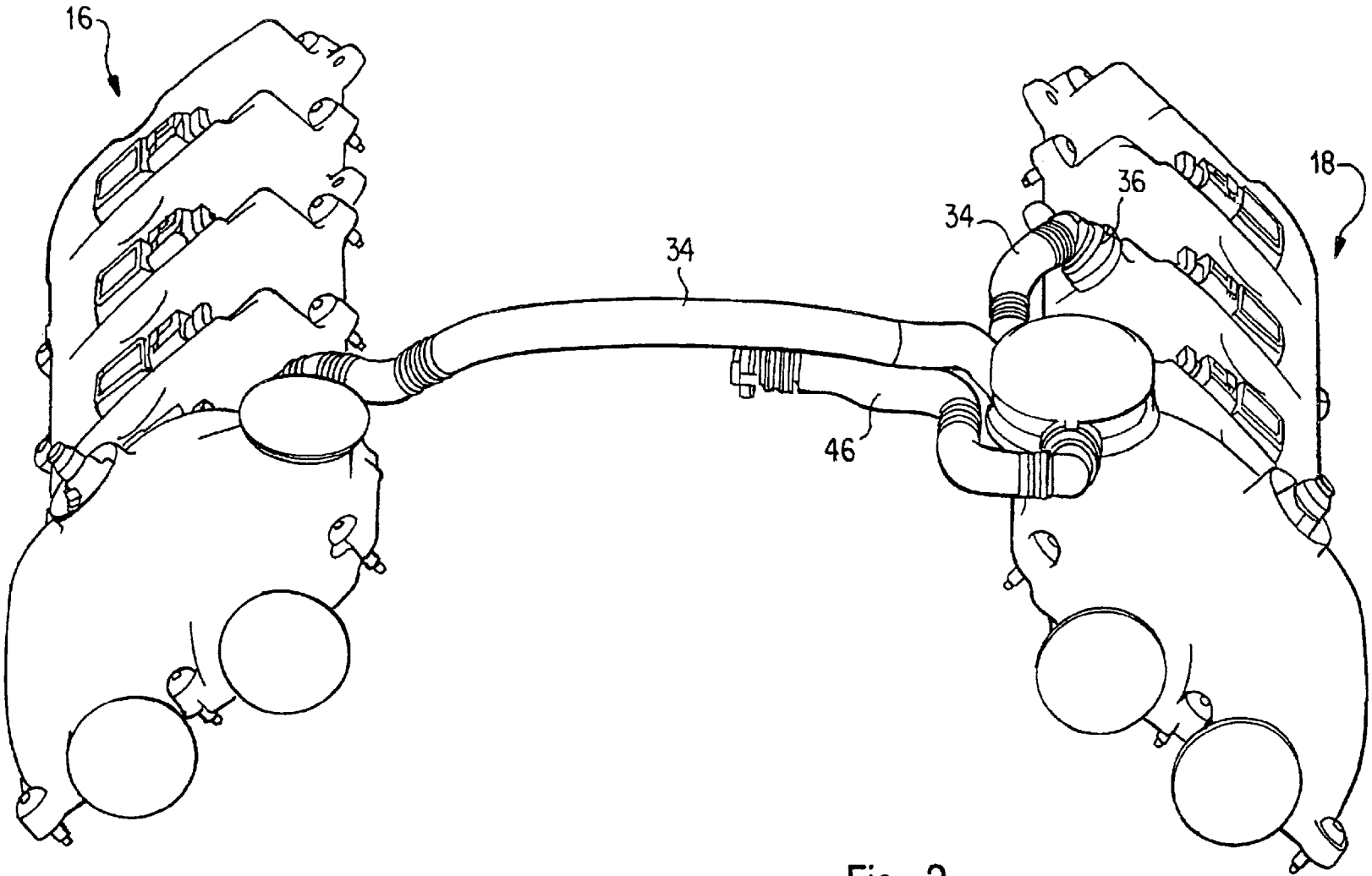
FIG. 2 is a perspective view showing the two cylinder head covers of the internal combustion engine of FIG. 1.
Figure 3:
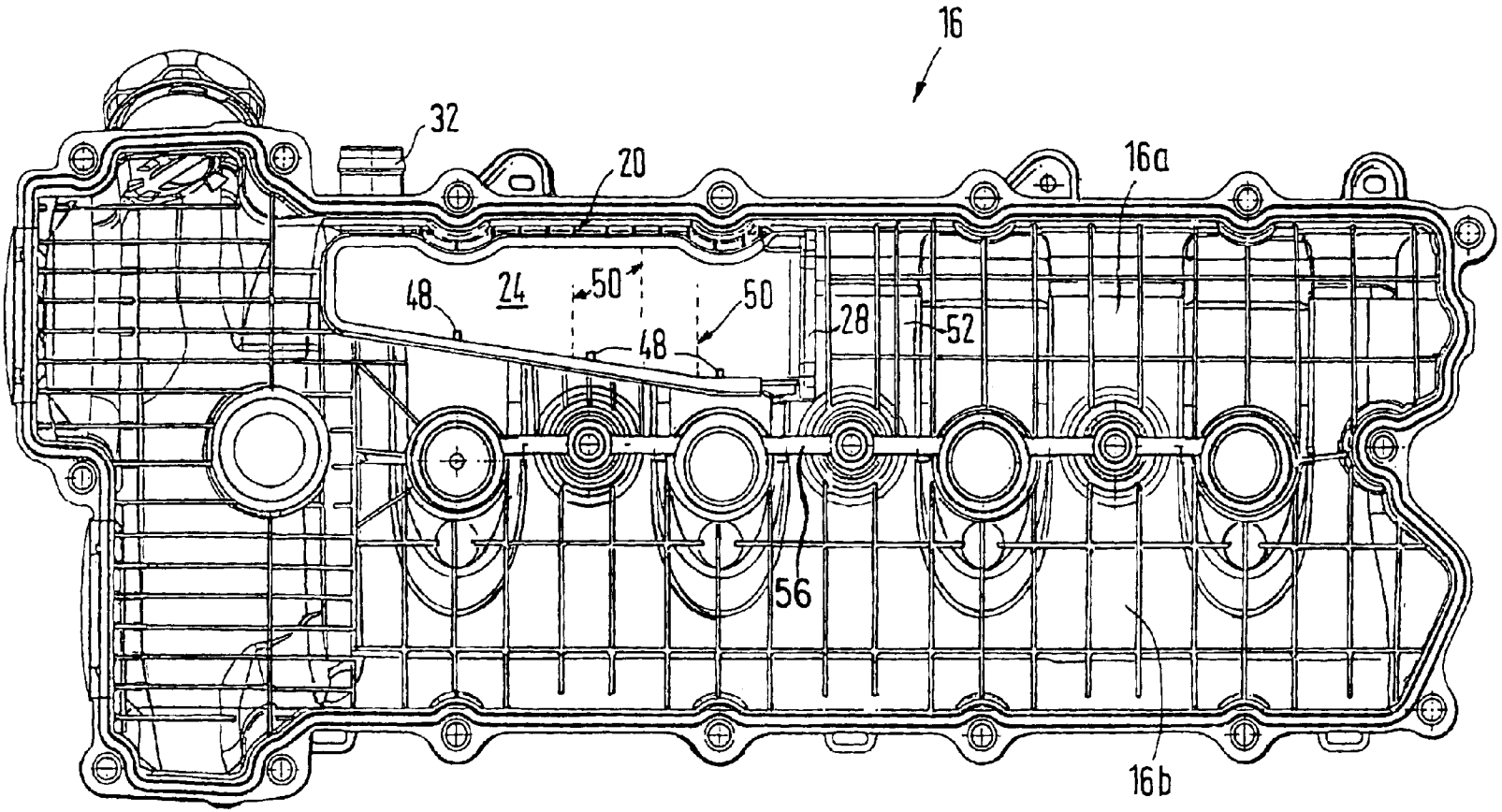
FIG. 3 is an interior view of a first cylinder head cover.

The two oil separation chambers 20, 22 each have an inlet opening 28, 30 through which the blow-by gases can enter the respective oil separation chambers 20, 22. A fitting 32 provided on cylinder head cover 16 forms the outlet opening for the oil separation chamber 20. As may be seen in FIG. 2, a ventilation or connecting line 34 is connected to the outlet fitting 32 and leads to cylinder head cover 18, while its other end is attached to an inlet fitting 36 that is provided on a cylinder head cover 18. The inlet fitting 36 is arranged on cylinder head cover 18 in such a way that it opens into the camshaft space 17 which is sealed by cylinder head 18, directly adjacent to the inlet opening 30 of the oil separation chamber 22.

Figure 7:
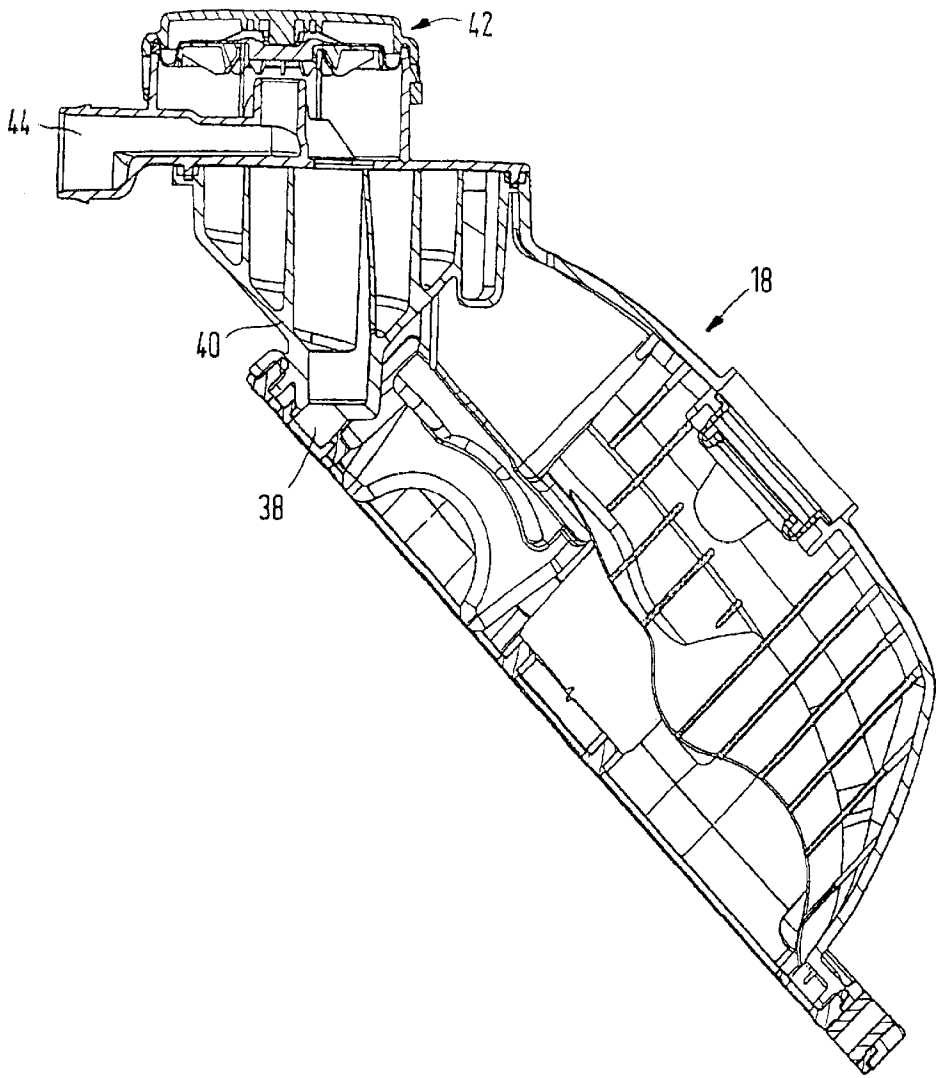
FIG. 7 is a cross-sectional view through the second cylinder head cover shown in FIG. 4.

The oil separation chamber 22 communicates with a helical oil separator 40 through an outlet opening 38. A pressure regulator 42 is mounted on the helical oil separator 40 and if necessary reduces the negative pressure within the crankcase space relative to the negative pressure present within the intake system. The pressure regulator 42 is provided with an outlet fitting 44 (FIG. 7) to which a line 46 is connected which leads to the intake pipe of the intake system (not depicted) of the internal combustion engine.

The two oil separation chambers 20, 22 are furthermore provided with openings 48 along the edges of their covers through which the lubricating oil contained in the oil separation chambers 20, 22 can pass into the camshaft space 17. Moreover, partitions 50 (dashed lines) acting as a labyrinth can be arranged in the oil separation chambers 20, 22.

Figure 5:
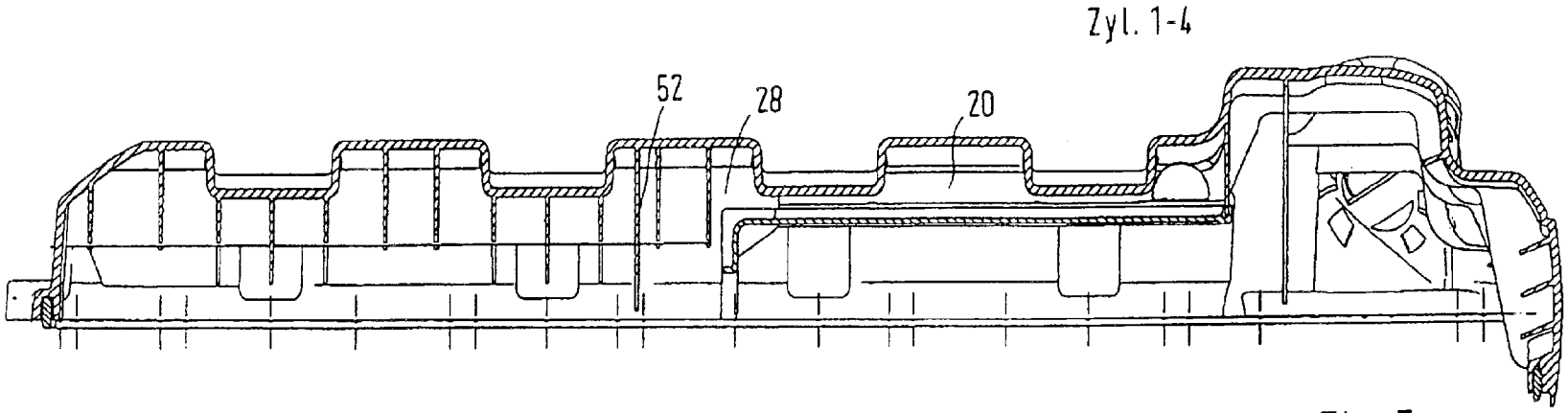
FIG. 5 is a longitudinal section through the first cylinder head cover shown in FIG. 3.
Figure 6:
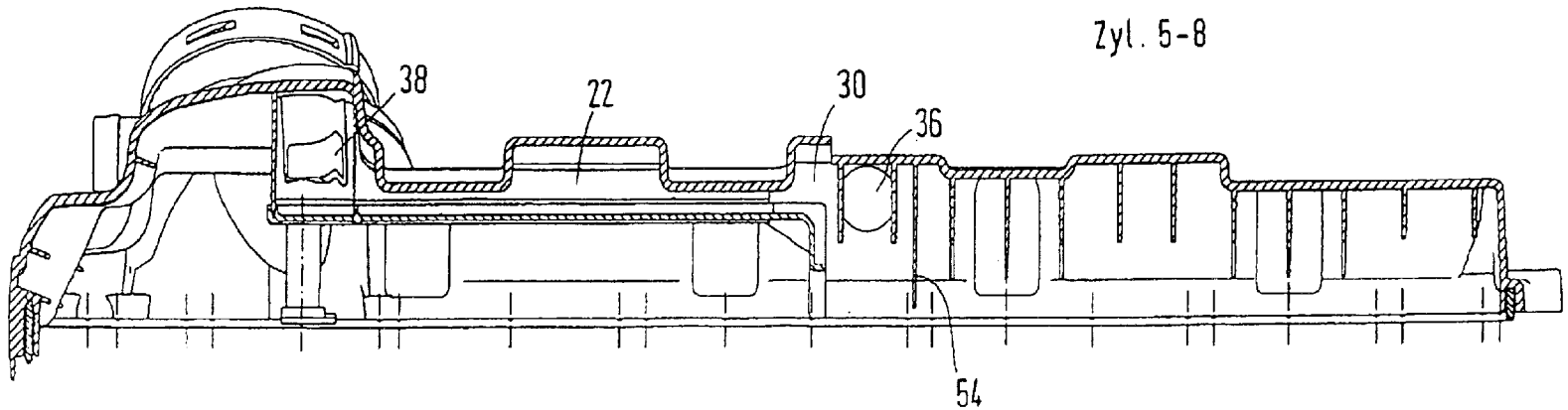
FIG. 6 is a longitudinal section through the second cylinder head cover shown in FIG. 4.

As may be seen particularly in FIGS. 5 and 6, a separation fin 52 or 54 is spaced at a distance from the two entry openings 28 and 30. The two fins 52, 54 prevent lubricating oil of the camshaft-bearing lubricating oil supply that is provided at this level from reaching the oil separation chambers 20, 22 through respective openings 28, 30. Center fins 56, 58 each extend in the center of the two cylinder head covers 16, 18, as viewed in the longitudinal driving direction. Center fins 56, 58 additionally partition the respective oil separation chamber 20, 22 arranged in the cylinder head cover region 16*a*, 18*a* and prevent lubricating oil from being thrown into the cylinder head cover regions 16*a*, 18*a* due to the rotating exhaust camshaft 11, 12 in each cylinder head region 16*b*, 18*b*.

The ventilation path for the blow-by gases after they have been transferred from the crankcase space into the camshaft space 17 is as follows. The blow-by gases of the left cylinder bank 1 to 4 are guided through opening 28 and into the oil separation chamber 20 due to the negative pressure conditions in the intake pipe. In the oil separation chamber 20, a portion of the lubricating oil carried along by the blow-by gases is separated and is again returned to the camshaft space 17 via openings 48, especially in non-steady operation (e.g., acceleration, braking). The blow-by gases are then transported through the connecting or ventilation line 34 to the right cylinder bank 5 to 8 and into the cylinder head cover 18. There they enter the camshaft space 17 and are guided through opening 30 together with the blow-by gases from the right cylinder bank and into the second oil separation chamber 22. There too, a portion of the entrained oil components are separated and can in turn be discharged through openings 48 into the camshaft space 17 of the right cylinder bank.

Finally, the precleaned blow-by gases reach the helical oil separator 40 and from there are returned in clean condition through pressure regulator 42 and line 46 into the intake pipe and thus into the intake system of the internal combustion engine. The oil separation chambers 20, 22 are thus integrated in the two cylinder head covers 16, 18 so that the two inlet openings 28, 30 are arranged substantially in the center of cylinder head covers 16, 18 relative to their longitudinal extension. This ensures reliable crankcase ventilation even if the vehicle travels uphill or downhill.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

We claim:

1. Internal combustion engine having at least two cylinder banks in which cylinder heads are sealed by cylinder head covers, ventilation lines are connected to the cylinder head covers and communicate with a negative pressure source blow-by gases, and an interior of each of the cylinder head covers is configured to pre-separate oil from the blow-by gases, wherein, as a part of the crankcase ventilation, oil separation chambers are equipped with inlet and outlet openings and are operatively arranged in the cylinder head covers to communicate with a respective camshaft space via respective inlet openings thereof and each of the oil separation chambers is integrated into the cylinder head cover such that the respective inlet opening of each oil separation chamber is arranged substantially centrally of the cylinder head cover as viewed in a longitudinal direction thereof.

2. Internal combustion engine as claimed in claim 1, wherein each of the oil separation chambers is sealed by a respective separate cover.

3. Internal combustion engine having at least two cylinder banks in which cylinder heads are sealed by cylinder head covers, ventilation lines are connected to the cylinder head covers and communicate with a negative pressure source blow-by gases, and an interior of each of the cylinder head covers is configured to pre-separate oil from the blow-by gases, wherein, as a part of the crankcase ventilation, oil separation chambers are equipped with inlet and outlet openings and are operatively arranged in the cylinder head covers to communicate with a respective camshaft space via respective inlet openings thereof, wherein each of the oil separation chambers is sealed by a respective separate cover and each of the oil separation chambers is integrated into the cylinder head cover such that the respective inlet opening of each oil separation chamber is arranged substantially centrally of the cylinder head cover as viewed in a longitudinal direction thereof.

4. Internal combustion engine as claimed claim 1, wherein the outlet opening of the second oil separation chamber is operatively associated with an oil separator integrated in its associated cylinder head cover.

5. Internal combustion engine, having at least two cylinder banks in which cylinder heads are sealed by cylinder head covers, ventilation lines are connected to the cylinder head covers and communicate with a negative pressure source blow-by gases, and an interior of each of the cylinder head covers is configured to pre-separate oil from the blow-by gases, wherein, as a part of the crankcase ventilation, oil separation chambers are equipped with inlet and outlet openings and are operatively arranged in the cylinder head covers to communicate with a respective camshaft space via respective inlet openings thereof wherein the outlet opening of the second oil separation chamber is operatively associated with an oil separator integrated in its associated cylinder head cover each of the oil separation chambers is integrated into the cylinder head cover such that the respective inlet opening of each oil separation chamber is arranged substantially centrally of the cylinder head cover as viewed in a longitudinal direction thereof.

6. Internal combustion engine as claimed in claim 5, wherein each of the oil separation chambers is sealed by a respective separate cover.

7. Internal combustion engine as claimed in claim 4, wherein a pressure regulator has an outlet operatively connected with the intake pipe of the internal combustion engine and is operatively mounted to an oil separator.

8. Internal combustion engine as claimed in claim 7, wherein each of the oil separation chambers is integrated into the cylinder head cover such that the respective inlet opening of each oil separation chamber is arranged substantially centrally of the cylinder head cover as viewed in a longitudinal direction thereof.

9. Internal combustion engine as claimed in claim 8, wherein each of the oil separation chambers is sealed by a respective separate cover.

* * * * *